US005499766A

United States Patent [19]

Foster et al.

[11] Patent Number: 5,499,766

[45] **Date of Patent: *Mar. 19, 1996**

[54] NOZZLE ASSEMBLY FOR TRIGGER SPRAYER

[75] Inventors: Donald D. Foster, St. Charles; Philip L. Nelson, Ellisville, both of Mo.

[73] Assignee: Contico International, Inc., St. Louis, Mo.

[ * ] Notice: The term of this patent shall not extend beyond the expiration date of Pat. No. 5,368,234.

[21] Appl. No.: 346,394

[22] Filed: Nov. 29, 1994

Related U.S. Application Data

[63] Continuation of Ser. No. 808,168, Dec. 13, 1991, Pat. No. 5,368,234.

[51] Int. Cl.[6] ..... B05B 1/12; B05B 9/043

[52] U.S. Cl. ..... 239/333; 239/481

[58] Field of Search ..... 239/333, 476–481

[56] References Cited

U.S. PATENT DOCUMENTS

| | | | |
|---|---|---|---|
| 2,558,779 | 7/1951 | Pesce | 239/477 |
| 3,061,202 | 10/1962 | Tyler | 239/333 |
| 3,149,755 | 9/1964 | Porter et al. | 222/83 |
| 3,650,473 | 3/1972 | Malone | 239/333 |
| 3,746,261 | 7/1973 | Nozawa et al. | 239/333 |
| 3,843,030 | 10/1974 | Micallef | 222/554 |
| 3,967,765 | 7/1976 | Micallef | 222/554 |
| 4,204,614 | 5/1980 | Reeve | 222/153 |
| 4,257,561 | 3/1981 | McKinney | 239/581.2 |
| 4,358,057 | 11/1982 | Burke | 239/333 |
| 4,433,799 | 2/1984 | Corsette | 222/309 |
| 4,516,695 | 5/1985 | Garneau | 222/153 |
| 4,624,413 | 11/1986 | Corsette | 239/333 |
| 4,640,444 | 2/1987 | Bundschuh | 239/333 |
| 4,706,888 | 11/1987 | Dobbs | 239/478 |
| 4,890,792 | 1/1990 | Martin et al. | 239/347 |
| 4,925,106 | 5/1990 | Maas et al. | 239/333 |
| 4,940,186 | 7/1990 | Tada | 239/333 |
| 4,989,790 | 2/1991 | Martin et al. | 239/483 |
| 4,991,778 | 2/1991 | Maas et al. | 239/333 |
| 5,234,166 | 8/1993 | Foster et al. | 239/333 |
| 5,267,692 | 12/1993 | Maas et al. | 239/333 |

FOREIGN PATENT DOCUMENTS

| | | | |
|---|---|---|---|
| 60-44023 | 5/1985 | Japan . | |
| 60-183056 | 9/1985 | Japan . | |
| 209382 | 8/1924 | United Kingdom | 239/476 |

*Primary Examiner*—Andres Kashnikow
*Assistant Examiner*—Lesley D. Morris
*Attorney, Agent, or Firm*—Rogers, Howell & Haferkamp

[57] ABSTRACT

A nozzle assembly for a trigger sprayer having a cap rotatable relative to a housing to establish the spray character of the fluid discharged and a slot and cam follower connection between the trigger sprayer housing and the cap with the cam shaped to impart an "off" condition, a gradually increasing spray condition, a combination spray and stream condition of gradually reversed relative influence, and a stream only condition. The different flow conditions are established by the interrelationship between a spinner head section and the cap that is rotatable along a path controlled by the cam and cam follower.

18 Claims, 2 Drawing Sheets

FIG. 1.
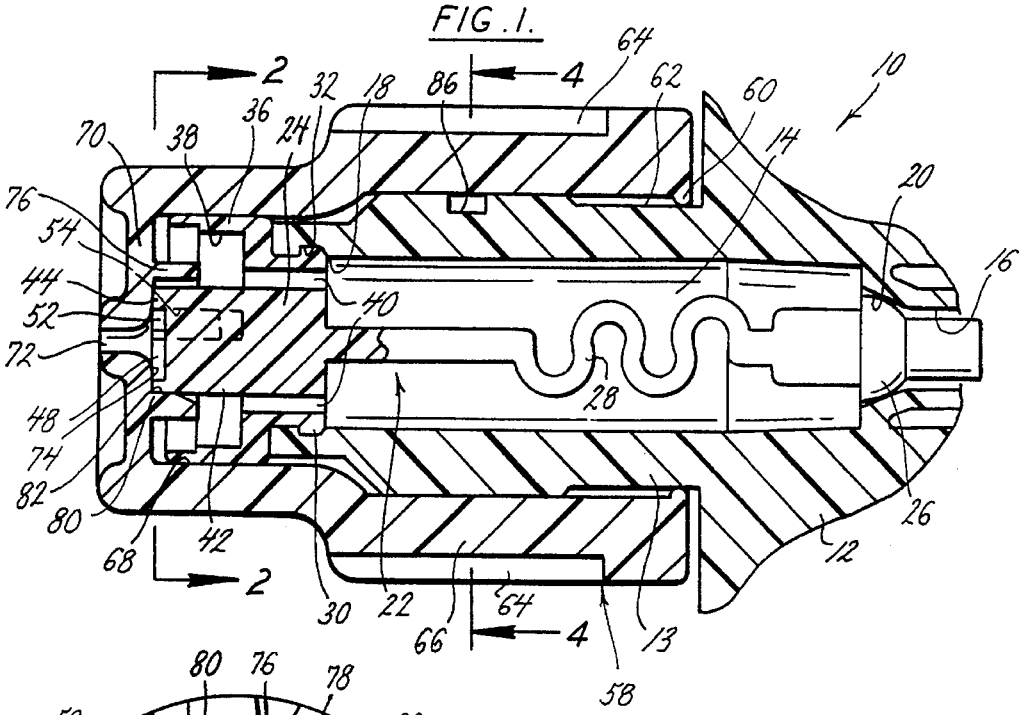
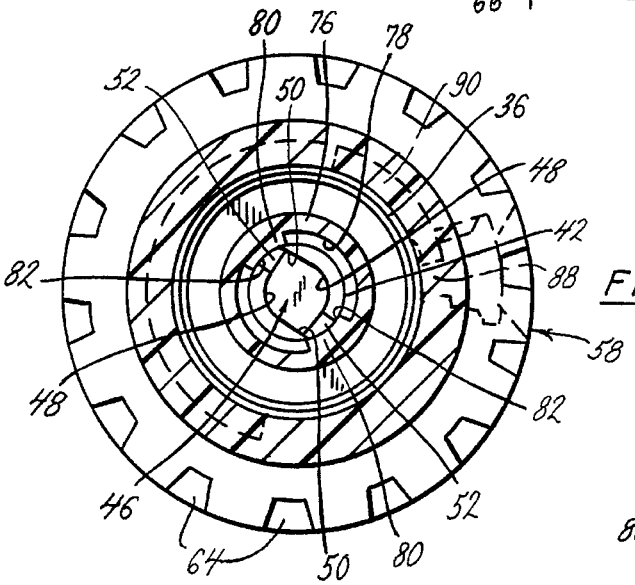
FIG. 2.
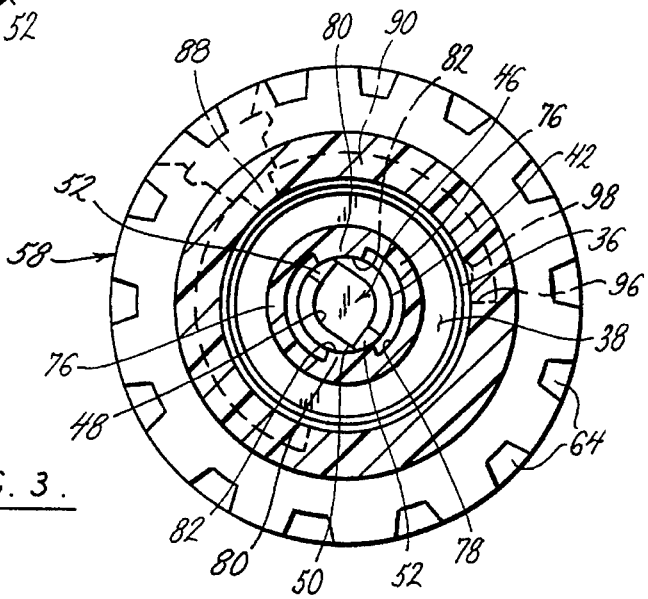
FIG. 3.

NOZZLE ASSEMBLY FOR TRIGGER SPRAYER

This is a continuation of application Ser. No. 07/808,168 filed on Dec. 13, 1991, entitled "NOZZLE ASSEMBLY FOR TRIGGER SPRAYER" which issued as U.S. Pat. No. 5,368,234 on Nov. 29, 1994.

BACKGROUND OF THE INVENTION

This invention relates to a nozzle assembly for a trigger sprayer and more particularly to a nozzle assembly that incorporates a cam and cam follower for controlling the relative positions of a cap and a housing to selectively establish the flow condition of fluid discharged from the trigger sprayer.

A typical trigger sprayer has a housing incorporating a fluid chamber. A manually actuable trigger pumps fluid from a fluid source to the fluid chamber. A spinner at the outlet end of the fluid chamber has a swirl chamber that can impart a spray condition to fluid being discharged from the housing chamber. A cap is threaded onto the housing and the rotational position of the cap changes the flow condition of fluid from a spray condition to a stream condition. This is caused by the threaded connection of the cap to the housing in a typical helical threading configuration. In one threaded position of the cap, a spray condition is achieved with the fluid being discharged through an outlet orifice in the cap. As the cap is threaded relative to the housing, a stream character is introduced and with further threading of the cap, the influence of the stream condition increases while the influence of the spray character decreases. Still further threading of the cap achieves a stream only condition, These threaded cap arrangements do not provide selective control that enables adjustment of the spray characteristic of the discharged fluid without influence from a stream characteristic and separately do not impart a gradually increasing stream condition with a corresponding gradually decreasing spray condition to be followed by a stream only condition that is maintained over a finite span of rotation of the cap.

Some efforts have been made to incorporate a cam and cam follower in a trigger sprayer. Malone U.S. Pat. No. 3,650,473 and Micheloff U.S. Pat. No. 4,234,128 represent examples of these efforts. In the Malone patent, only two spray conditions are established by the position of the cap relative to the spray body. These two conditions are a spray condition and a stream condition. In order to establish an "off" condition, it is necessary to operate a separate hinged cover. Also, in the Malone device, there are no variations of the spray condition without immediate influence from the stream condition.

In the Micheloff patent, the trigger sprayer works differently from the manner of the present invention. The Micheloff trigger sprayer discloses a cap that is rotatably mounted on a sprayer body, but there are neither threads nor camming means for moving the cap axially relative to the sprayer body or relative to a spinner. In one condition, the nozzle assembly is in an "off" condition. Upon rotation of the cap a flow condition is established. Further rotation of the cap establishes a stream condition. These different conditions are achieved by the changing communications between passageways on a core and passageways on a sleeve and when none of the passageways are in communication, fluid flow is blocked.

The nozzle assembly of the present invention provides a cap that is both rotatably and axially movable relative to a housing, the path of movement being determined by a cam slot and cam follower connection between the cap and housing. The configuration of the cam slot allows the user to create a spray that is variable in character with no influence by a stream condition as the cap is rotated through an initial path. Further rotation of the cap through a second path introduces a variable coarse spray in which the effect of the spray condition is gradually influenced by the introduction of a stream condition. As the cap is rotated toward the end of the second cam section, a stream condition is reached that has eliminated the influence of the spray condition. Finally, there is a third cam section where the stream-only condition is maintained with assurance that the cap will not jiggle back to a position that introduces influence from the spray condition.

SUMMARY OF THE INVENTION

This nozzle assembly incorporates a housing that supports a spinner. A cap is mounted on the housing. A cam follower on the cap projects into a slot on the housing. The spinner has diametrically opposed slots communicating with a central recess that functions as a swirl chamber. The central recess is surrounded by a wall or sleeve and is axially aligned with a nozzle orifice in the cap. In the closed condition, the wall or sleeve surrounding the swirl chamber projects against the cap and blocks the two diametrically opposed slots and the spinner while the outer wall of the sleeve engages opposing faces on hubs on the cap.

Upon initial rotation of the cap relative to the sprayer body, a first section of a cam slot causes the cap to move in a path of rotation with no axial component, gradually opening the opposed slots so that fluid can flow into the central swirl chamber and discharge through the nozzle orifice in a spray condition. The first section of the camming slot is long enough to allow the cap to be rotated through an arc that gradually increases the sizes of the diametrically opposed slots so the fluid spray will be adjusted from very fine to full without introducing the effect of a stream flow condition.

Further rotation of the cap will move its cam follower to a second section of the slot that is ramped to provide both rotational and axial movement of the cap relative to the housing. Initial movement of the cap away from the housing separates the cap from the opposing face of the spanned and introduces a small amount of stream effect mixed with the spray condition. As the cap is moved axially further away from the spinner, the effect of the stream condition is progressively increased and the effect of the spray condition is progressively decreased. Therefore, the discharge condition of the fluid becomes gradually more coarse. Finally, the ramp or second section of the slot moves the cap axially far enough from the spinner to completely remove the spinner from the sleeve that had surrounded the swirl chamber thereby providing a full and direct flow of fluid past the spinner to the nozzle orifice without passing through the swirl chamber. This condition maximizes the stream condition and eliminates the effect of the spray condition. Finally, a third section of the camming slot allows positioning of the cam follower to maintain the stream character of flow so that it will not jiggle back into the second ramped slot section.

BRIEF DESCRIPTION OF THE DRAWINGS

FIG. 1 is a view in longitudinal medial section showing the cap and spinner oriented to an "off" position blocking the flow of fluid through the nozzle assembly;

FIG. 2 is a view in section taken along the plane of the line 2—2 of FIG. 1 showing the cap rotated to the "off" position where it blocks the flow of fluid through the spinner;

FIG. 3 is a view in section similar to that 10 of FIG. 2 but showing the cap rotated to establish a spray character to fluid flow through the spinner;

DETAILED DESCRIPTION OF THE PREFERRED EMBODIMENT

Figure 4:
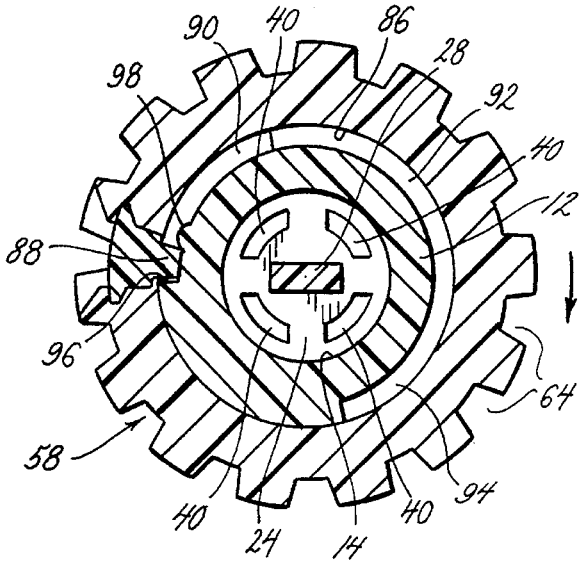
FIG. 4 is view in section taken along the plane of the line 4—4 in FIG. 1.

A typical trigger sprayer has a housing with a manually actuable trigger. When the trigger is squeezed, spray liquid will be pressurized to flow through a nozzle assembly and be discharged through a nozzle orifice. Such trigger sprayers of various configurations are known in the art.

The plastic nozzle assembly 10 of this invention is adapted to be incorporated into such a trigger sprayer. The trigger sprayer body 12 that is joined to the remaining portions of the trigger sprayer (not shown) has 30 a generally cylindrical side wall 13 surrounding a fluid chamber 14 that extends axially between a fluid inlet 16 and a fluid outlet 18. There is a valve seat 20 at the fluid inlet 16.

A plastic spinner 22 has a head section 24 adjacent the outlet 18 and a valve piston 26 adjacent the inlet 16. The valve piston is rounded to close the inlet when seated against the valve seat 20. An integral spring 28 extending between the spinner head section 24 and the piston 26 biases the piston 26 toward a seating condition against the valve seat 20 as illustrated in FIG. 1. However, when the trigger (not shown) of the trigger sprayer is actuated to generate the flow of pressurized fluid, the fluid will push the piston 26 away from the valve seat 20 and fluid will flow into the chamber 14.

The head section 24 of the spinner 22 has an annular ring 30 that cooperates with an annular groove 32 in the housing 12 and allows the spinner head section 24 to be snapped into position across the housing outlet 18. Forward of the annular ring 32, the spinner head section 24 has a cylindrical skirt or sleeve 36 that surrounds a fluid chamber 38 in the spinner head section 24. There are passages 40 through the spinner head section 24 that establish constant fluid communication between the housing chamber 14 and the head section chamber 38.

Radially inward of the cylindrical skirt or sleeve 36, the head section 24 of the spinner has a central cylindrical projection 42 that extend forwardly beyond the forward edge of the skirt 36 and terminates in a flat front end or face 44. There is a recess 46 in the center of the flat end 44. The recess 46 has opposed arcuate walls 48 that terminate in straight sections 50. Each straight section 50 defines a side of one of a pair of diametrically opposed openings 52 that extend through the forward portions of the spinner projection 42. Preferably, each opening 52 communicates with an elongated groove 54 extending longitudinally in the side wall of the head section projection 42. The openings, when unblocked, establish fluid communication between the spinner head chamber 38 and the recess 46. Because of the shape and orientation of the walls, when fluid enters the recess 46 through the openings 52, it will be guided initially by the flat walls into swirling contact with the arcuate walls 48. Thus the recess 46 and its side walls function as a fluid swirl chamber.

A plastic cap 58 is mounted on the housing 12 and is removably held in place by a radially inwardly projecting yieldable ring 60 on the cap that snaps into an axially elongated annular groove 62 in the housing 12. The groove 62 retains the cap on the housing while permitting it to slide axially relative to the housing and the spinner head section 24. The cap has splines 64 around its outer body to facilitate manual rotation of it.

Forward of the annular ring 60, the cap 58 has a wall 66 that slides along the side wall 13 of the housing 12. Further forward, the cap 58 has an annular inner wall 68 that maintains sliding contact with the outer wall after wall 36 of the spinner head section 24, maintaining a constant fluid seal. At its forward end, the cap 58 has a front wall 70. There is a nozzle orifice 72 through the axial center of the front wall 70.

Surrounding the nozzle orifice 72 the wall 70 has a flat rear face 74 opposite the flat front end 44 of the spinner head section 24. Radially beyond the flat face 74, a tubular sleeve 76 projects rearwardly from the wall 70 of the cap 58. The tubular sleeve 76 has an inner wall 78 that is spaced outwardly from the projection 42 of the spinner head sections 24 except for two diametrically opposed inwardly extending hubs 80 that have inner arcuate faces 82 on them for making and maintaining fluid-tight contact with the outer surface of the head projection 42. Thus, the head section chamber 38 extends into the areas between the inner wall 78 and the projection 42 on opposite sides of the hubs 80. As shown in FIG. 2, the hubs 80 are wider than are the openings 52 through the front of the spinner head section 24.

Figure 6:
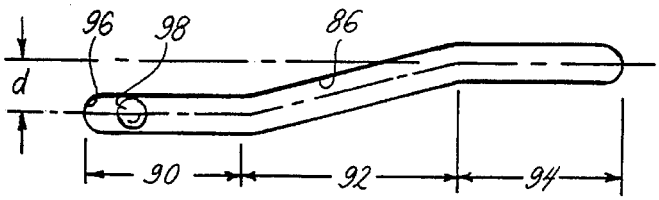
FIG. 6 is a diagrammatic view of the cam slot.

The orientation of the cap 58 relative to the spinner head section 24 is controlled by a cam and cam follower configuration. For this, there is a cam slot 86 in a peripheral portion of the wall 13 of the housing 12 and a cam follower projection 88 on the cap projecting inwardly from the wall 66 of the cap 58 and into the slot 86. As shown in FIG. 6, the slot 86 has an initial section 90 that is axially flat in that it follows only a radius of the housing wall 13 followed by an intermediate section 92 that is ramped or inclined to extend axially forwardly as well as around a radial portion of the housing 12. A final section 94 that is axially forward of the initial section 90 and is flat about only a radius of the housing wall 13, with no axial component. As see in FIG. 4, the cam slot 86 extends around less than a full circumference of the cylindrical sidewall 13 of the trigger sprayer body 12.

Figure 5:
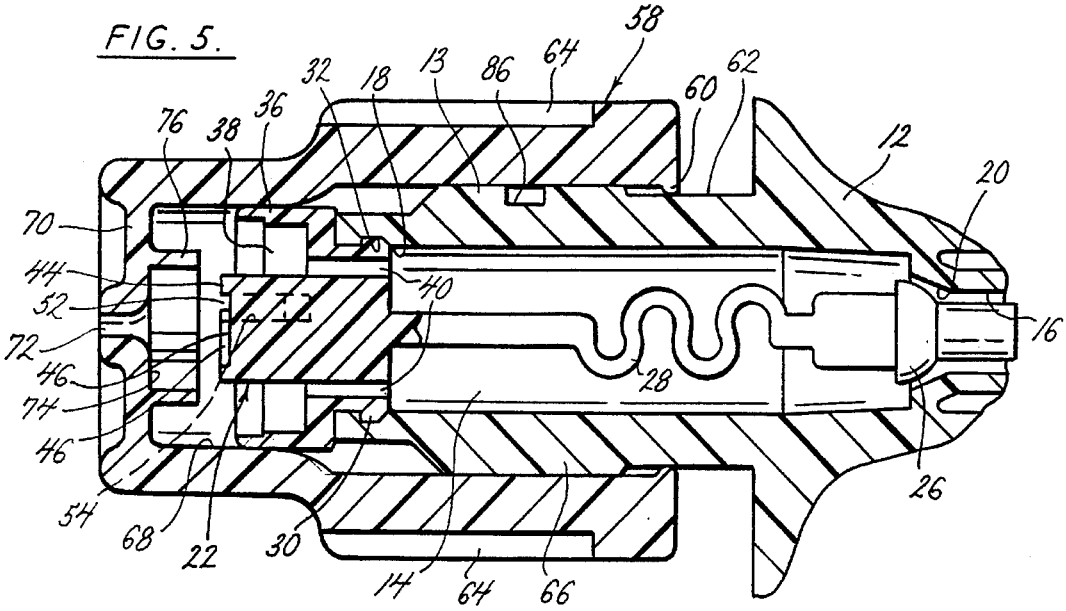
FIG. 5 is a view in longitudinal medial section through the nozzle assembly showing the cap and spinner oriented to establish a stream character to fluid flow through the spinner.

Adjacent the initial end 96 of the slot 86, there is a detent 98 at the base of the slot 86, as shown in FIGS. 4 and 6. In the initial rotated position of the cap 58, the cam follower 88 will have snapped past the detent 98 into position against the initial end 96 of the slot. When the cap 58 is manually rotated, the cam follower 88 will snap past the detent 98 and, because the initial section 90 of the cam slot 86 is entirely radial, movement of the cap 58 will be only in a rotational direction with no axial component. As the cap 58 is rotated further, the cam follower reaches and rides along the ramp section 92, and this ramp section 92 causes the cam follower to move the cap in a forward axial direction by 30 a distance d (FIG. 6) determined by the length and slope of the intermediate slot section 92 until it reaches the position illustrated in FIG. 5 where the cam follower reaches the third section 94 of the slot. As seen in FIG. 5, the dimension of the sleeve 76 is sufficiently short that when the cap 58 is rotated to the position relative to the housing 12 shown in FIG. 5, the projection 42 is fully withdrawn from the sleeve. At the end of the intermediate section 92, the cam follower 86 reaches and is guided along the final section 94 which again, because it is entirely radial with no axial component, results in no further axial movement of the cap as it is rotated.

OPERATION

When pressurized fluid is introduced through the inlet 16 of the housing 12, such as by manually squeezing a trigger sprayer trigger (not shown), the spring 28 yields and the normally seated valve 26 is pushed away from the valve seat 20. This,allows the pressurized fluid to flow into the chamber 14. Since the passages 40 are in constant communications with the housing chamber 14, the pressurized fluid will also fill the spinner head chamber 38.

The rotational position of the cap 58 together with the configuration of the cam slot 86 and cam follower 88 determine the nature of fluid flow from the spinner head chamber 38. When the user wants the trigger sprayer in the "off" condition, the cap is manually rotated in a counterclockwise direction as viewed in FIG. 4 (clockwise as viewed in FIGS. 2 and 3) until the cam follower 88 snaps past the detent 98 and against the end 96 of the slot 86. In this condition, the flat end face 44 of the spinner 24 is in fluid-tight contact with the flat annular wall section 74 on the end wall 70 of the cap 58. Furthermore, as shown in FIG. 2, the inner arcuate faces of the hub 80 span the passages 52 and overly outer surface portions of the projection 42 in sealing engagement. Consequently, fluid cannot flow from the spinner head chamber 38 past the end 44 of the spinner head projection 42 or through the openings 52 in the sides of the spinner head projection 42. Therefore, no fluid can reach the swirl chamber 46.

To initiate fluid flow, the cap 58 is rotated in a clockwise direction as viewed in FIG. 4 (counterclockwise as viewed in FIGS. 2 and 3). First, the cam follower 88 will snap past the detent 98 which had held the cap in its "closed" condition. As indicated in FIG. 6, the initial rotation of the cap 58 will move the cam follower along the initial section 90 of the slot 86. As the cam follower 88 moves along the section 90 of the slot 86, the cap 58 is restricted to rotational movement relative to the housing 12 and the spinner head section 24. Therefore, the end wall 44 stays in fluid-tight contact with the annular face 74 of the end wall 70 on the Cap, but fluid can flow through the openings 52.

Initial exposure of the openings 52 allows a restricted amount of fluid to flow into a swirl chamber 46 thereby maintaining high pressure swirling of the fluid and a wide spray pattern of fluid discharged through the nozzle orifice 72. Further rotation of the cap 58, while the cam follower 88 continues to follow the section 90 of the slot 86, further opens the passages 52 as they rotate beyond the hubs 80. This gradually increases the volume of fluid flow into the swirl chamber 46 while reducing its velocity, resulting in a greater rate of flow at a less widely dispersed spray pattern through the nozzle orifice 72. During this entire rotation through the section 90, no axial movement is imparted to the cap 58 relative to the housing 12 and the spinner head section 24. Consequently, the variable adjustment of the spray pattern can be done without introduction of a stream pattern to the fluid flow.

As the cap 58 is rotated further and enters the ramped second section 92, axial movement is also imparted to the cap. The face 44 of the spinner head section 24 is initially slightly withdrawn from the rear surface 74 of the wall 70. This allows a limited amount of fluid to flow past the face 44, bypassing the swirl chamber 46, to the outlet orifice nozzle 72, imparting a small stream character to what otherwise is a spray pattern of the fluid. Continued rotation of the cap, causing the cam follower 88 to move further up the ramp section 92, further withdraws the spinner head section 24 from the end wall 70, progressively increasing the volume rate of flow of fluid bypassing the swirl chamber 46. At the same time, the cylindrical projection 42 on the spinner head section 24 is being progressively withdrawn from the cylindrical sleeve 76. Consequently, the influence of the stream character of the fluid flow is correspondingly gradually and progressively increased and the incidence of the spray character is progressively decreased as the amount of fluid flowing through the swirl chamber 46 progressively decreases. However, over the majority of the axial movement produced by the second section, the cylindrical projection 42 remains at least partially encircled by the sleeve 76 maintaining a gradually reducing independence to the effect of the stream condition. Ultimately, rotation of the cap 58 and the sleeve 76 being sufficiently short causes the spinner head section 24 to be withdrawn from the sleeve 76 the position illustrated in FIG. 5 where all of the fluid bypasses the swirl chamber 46 and a full stream condition, without spray influence, is imparted to the fluid.

The third section 94 of the slot 86 assures the operator that the stream condition is maintained. As the cap is rotated to move the cam follower 88 along the third section 94, no change in the maximum spray condition of fluid flow occurs. The third section 94 thus maintains the stream flow condition without danger that the cap will unintentionally jiggle far enough to put the cam follower 88 back on the ramped second section 92 and re-introduce a spray character to the flow.

While the present invention has been described by reference to specific embodiments, it should be understood that modifications and variations of the invention may be constructed without departing from the scope of the invention defined in the following claims.

What is claimed is:

1. A nozzle assembly for a trigger sprayer comprising:

a housing defining a fluid chamber, an inlet to the fluid chamber for introducing pressurized fluid into the chamber upon actuation of the trigger sprayer, a spinner defining a wall of the chamber, a cap mounted on the housing and having a nozzle orifice through it, passage means through the spinner for establishing fluid communication between the chamber and the nozzle orifice;

a wall configuration on the spinner in communication with the nozzle orifice for imparting a spray pattern to fluid constrained to flow past the wall configuration and through the nozzle orifice, blocking walls on the cap and spinner moveable respectively into and out of contact upon rotation of the cap relative to the housing for alternately blocking and unblocking fluid flow from the passage means to the wall configuration and for establishing and progressively enlarging a fluid path that bypasses the wall configuration upon progressive axial separation of the cap from the spinner, and a cam slot and cam follower, one on the housing and the other on the cap with the cam follower extending into the cam slot, the cam slot having a configuration followed by the cam follower upon movement of the cap relative to the housing, said slot configuration having a first portion that causes the cam follower to initially locate the blocking walls in mutual contact for blocking fluid flow, a first section that causes the cam follower to maintain the moveable walls in axial contact for closing the bypass path while unblocking and progressively increasing the volume of fluid flow to the wall configuration for imparting and expanding a spray pattern of the fluid, and a second section that causes the cam follower to open and progressively enlarge the bypass path for Progressively changing the fluid discharge pattern from spray to stream.

2. The nozzle assembly of claim 1 wherein, the cam slot has a third section for causing the cam follower to maintain the discharge pattern in a maximum stream character.

3. The nozzle assembly of claim 1 wherein, the cam slot extends around less than a full circumference of the housing and the cam follower comprises a projection on the cap.

4. The nozzle assembly of claim 1 wherein, the spinner has a swirl chamber for imparting a spray character to fluid flow confined to the swirl chamber and wherein movement of the cap axially relative to the spinner establishes a fluid path that bypasses the swirl chamber enabling a stream character to be imparted to the fluid bypassing the swirl chamber.

5. A nozzle assembly for a trigger sprayer, the nozzle assembly comprising:

a housing having opposite forward and rearward ends and an interior fluid chamber extending axially through the housing between the forward and rearward ends, a fluid spinner provided at the forward end of the housing, the fluid spinner having a front face and the fluid spinner having at least one fluid passage extending therethrough, the fluid passage communicating with the housing fluid chamber, a cap mounted on the housing for rotational and axial movement of the cap relative to the housing, the cap having a rear face with an orifice nozzle extending therethrough, means provided on the cap and on the spinner for selectively blocking and unblocking a path of fluid flow from the spinner fluid passage to the cap orifice in response to rotational movement of the cap relative to the housing, and means provided on the cap and on the housing for selectively engaging and disengaging the cap rear face and the spinner front face in response to rotational and axial movement of the cap relative to the housing.

6. The nozzle assembly of claim 5 wherein:

the means for selectively blocking and unblocking the path of fluid flow from the spinner fluid passage to the cap orifice includes blocking walls on the cap and on the spinner, the blocking walls being configured to move into and out of contact upon rotation of the cap relative to the housing.

7. The nozzle assembly of claim 5 wherein:

the means for selectively engaging and disengaging the cap rear face with the spinner front face includes a cam slot and cam follower, one of the slot and follower on the housing and the other of the slot and follower on the cap, the cam follower extending into the cam slot, the cam slot being configured to guide the follower to move the cap rear face relative to the spinner front face upon movement of the cap relative to the housing.

8. The nozzle assembly of claim 7 wherein:

the cam slot is formed in the housing; and the cam follower extends from the cap.

9. The nozzle assembly of claim 7 wherein:

the cam slot includes a helical section configured to axially move the cap rear face relative to the spinner front face upon rotation of the cap relative to the housing.

10. The nozzle assembly of claim 9 wherein:

the means for selectively blocking and unblocking the path of fluid flow from the spinner fluid passage to the cap orifice includes a first blocking wall extending from the cap and a second blocking wall extending from the spinner, the first and second blocking walls being configured to move into and out of contact upon rotation of the cap relative to the housing; and the cam slot helical section is also configured to move the first and second blocking walls into and out of contact upon rotation of the cap relative to the housing.

11. A nozzle assembly for use in combination with a spray dispenser used for dispensing a liquid substance from a container in a selectively variable fluid discharge pattern and flow rate in response to actuation of the dispenser, the nozzle assembly comprising:

a fluid spinner having a swirl chamber formed therein for imparting a spin to fluid being dispensed from the dispenser;

a cap mounted adjacent the fluid spinner, the cap being rotatable relative to the spinner between first, second and third positions, the cap being configured to move axially away from the swirl chamber as the cap is rotated between the second and third positions to vary the fluid discharge pattern from a spray to a stream, the cap having an end wall with a nozzle orifice therein through which liquid is dispensed;

a passage defined by the fluid spinner and cap, the passage being configured to open and close in response to rotation of the cap between the second and first positions, respectively, to vary the flow condition between an on condition and an off condition; and a housing fixed to the spinner, one of the cap and the housing having a cam formed therein and the other of the cap and the housing having a cam follower configured to engage the cam and force the cap to move axially away from the spinner as the cap is rotated between the second and third positions.

12. The nozzle assembly of claim 11 wherein:

the cam is a slot formed in the housing.

13. The nozzle assembly of claim 11 wherein:

the cam is comprised of an arcuate section connected to a spiral section, the cam follower traversing the arcuate section as the cap is rotated between the first and second position, the follower traversing the spiral section as the cap is rotated between the second and third position.

14. The nozzle assembly of claim 11 wherein:

the cap is rotatable relative to the spinner between the third and a fourth position, the cap being configured to remain at a substantially constant distance from the spinner as the cap is rotated between the third and fourth positions to assure that the discharge pattern substantially consists of the stream as the cap is rotated between the third and fourth positions, and the cam is comprised of a second arcuate section connected to the spiral section, the cam follower traversing the second arcuate section as the cap is rotated between the third and fourth positions.

15. A nozzle assembly for use in combination with a spray dispenser used for dispensing a liquid substance from a container in a selectively variable fluid discharge pattern and flow rate in response to actuation of the dispenser, the nozzle assembly comprising:

a fluid spinner having a swirl chamber formed therein for imparting a spin to fluid being dispensed from the dispenser;

a cap mounted adjacent the fluid spinner, the cap being rotatable relative to the spinner between first, second, third and fourth positions, the cap being configured to move axially away from the swirl chamber as the cap is rotated between the second and third positions to vary the fluid discharge pattern from a spray to a stream, the cap having an end wall with a nozzle orifice therein through which liquid is dispensed, the cap being configured to remain a substantially constant distance from the spinner as the cap is rotated between the third and fourth positions to assure that the fluid discharge pattern substantially consists of the stream as the cap is rotated between the third and fourth positions; and a passage defined by the fluid spinner and cap, the passage being configured to open and close in response to rotation of the cap between the second and first positions, respectively, to vary the flow condition between an on condition and an off condition.

16. A nozzle assembly for use in combination with a spray dispenser used for dispensing a liquid substance from a container in a selectively variable fluid discharge pattern and flow rate in response to actuation of the dispenser, the nozzle assembly comprising:

a fluid spinner having a swirl chamber formed therein for imparting a spin to fluid being dispensed from the dispenser;

a cap mounted adjacent the fluid spinner, the cap being rotatable relative to the spinner between first, second and third positions, the cap being configured to move axially away from the swirl chamber as the cap is rotated between the second and third positions to vary the fluid discharge pattern from a spray to a stream, the cap having an end wall with a nozzle orifice therein through which liquid is dispensed; and a passage defined by the fluid spinner and cap, the passage being configured to open and close in response to rotation of the cap between the second and first positions, respectively, to vary the flow condition between an on condition and an off condition, the passage comprising a first portion formed in the spinner and a second portion formed in the cap, the first and second portions being totally aligned when the cap is located in the second position, when the cap is located in the third position and when the cap is located in any position between the second and third positions, the first and second portions being totally out of alignment when the cap is located in the first position, and the first and second portions being partially aligned when the cap is located in any position between the first and second positions.

17. The nozzle assembly of claim 16 wherein:

the first passage portion is an opening in the spinner, the opening having a first arc length, and the second passage portion is an arcuate groove formed in the cap, the groove having a second arc length, the second arc length being longer than the first arc length.

18. The nozzle assembly of claim 17 wherein:

the arcuate groove is formed adjacent an arcuate hub in the cap, the opening being aligned with the hub when the cap is in the first position.

* * * * *